US010056044B2

(12) United States Patent
Yang et al.

(10) Patent No.: US 10,056,044 B2
(45) Date of Patent: Aug. 21, 2018

(54) LIQUID CRYSTAL DISPLAY DEVICE AND DISPLAY FLICKERING METHOD

(71) Applicant: AU Optronics Corporation, Hsin-Chu (TW)

(72) Inventors: Chih-Hsiang Yang, Hsin-Chu (TW); Yih-Sheng Yu, Hsin-Chu (TW); Tsung-Shiun Lee, Hsin-Chu (TW); Yung-Chih Wu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 210 days.

(21) Appl. No.: 14/659,982

(22) Filed: Mar. 17, 2015

(65) Prior Publication Data

US 2015/0269892 A1 Sep. 24, 2015

(30) Foreign Application Priority Data

Mar. 18, 2014 (CN) ..... 2014 1 0100287
Mar. 10, 2015 (CN) ..... 2015 1 0104054

(51) Int. Cl.
*G09G 3/34* (2006.01)
*G09G 3/36* (2006.01)

(52) U.S. Cl.
CPC ..... *G09G 3/3426* (2013.01); *G09G 3/3406* (2013.01); *G09G 3/3622* (2013.01); *G09G 2320/0247* (2013.01); *G09G 2320/0626* (2013.01)

(58) Field of Classification Search
CPC ..... G09G 3/34–3/3426; G09G 3/36–3/3696
See application file for complete search history.

(56) References Cited

U.S. PATENT DOCUMENTS 6,129,436 A * 10/2000 Treskov ..... A61B 5/161 351/201
2005/0007389 A1 1/2005 Kumamoto et al.
2005/0057552 A1* 3/2005 Foo ..... G09G 3/20 345/211
2006/0146005 A1* 7/2006 Baba ..... G09G 3/3233 345/102
2007/0146300 A1 6/2007 Wu et al.
(Continued)

FOREIGN PATENT DOCUMENTS

CN 1560679 A 1/2005
CN 1565014 A 1/2005
(Continued)

*Primary Examiner* — David Tung
(74) *Attorney, Agent, or Firm* — WPAT, PC

(57) ABSTRACT

A liquid crystal display device and a display flickering method are provided. The display flickering method includes receiving a first instruction signal and a color selection signal from a time sequence control circuit; outputting a data signal and a control signal according to the first instruction signal and the color selection signal; displaying an image by at least one frame display frequency according to the data signal; providing a backlight source for illuminating the display panel by at least one backlight flicker frequency according to the control signal, in which the display panel displays the at least one image having at least one frame flicker frequency according to the at least one backlight flicker frequency and the at least one frame display frequency.

14 Claims, 13 Drawing Sheets

(56) References Cited

U.S. PATENT DOCUMENTS

| | | | | |
|---|---|---|---|---|
| 2009/0040200 | A1 | 2/2009 | Kan et al. | |
| 2010/0253611 | A1* | 10/2010 | Takagi | G09G 3/3611 345/98 |
| 2010/0271592 | A1* | 10/2010 | Katz | A61B 5/161 351/201 |
| 2011/0128461 | A1 | 6/2011 | Koyama et al. | |
| 2011/0213269 | A1 | 9/2011 | Harada et al. | |
| 2012/0147066 | A1* | 6/2012 | Fujiwara | G09G 3/3413 345/690 |
| 2012/0147291 | A1* | 6/2012 | Seo | G09G 3/342 349/62 |
| 2013/0038621 | A1* | 2/2013 | Choi | G09G 3/2092 345/589 |
| 2013/0187897 | A1* | 7/2013 | Liu | G09G 3/3648 345/204 |
| 2014/0002516 | A1 | 1/2014 | Koyama et al. | |

FOREIGN PATENT DOCUMENTS

| | | | |
|---|---|---|---|
| CN | 103092340 | A | 5/2013 |
| EP | 2343013 | A1 | 7/2011 |
| TW | I308315 | | 4/2009 |
| TW | 201225051 | | 6/2012 |

* cited by examiner

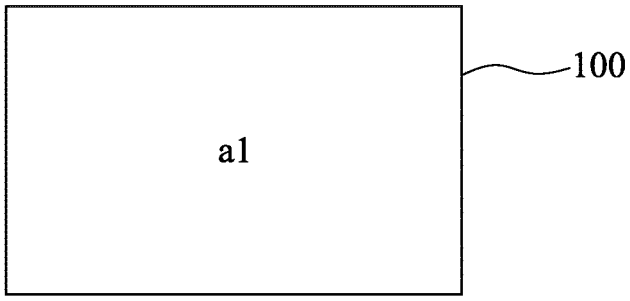
FIG. 1A
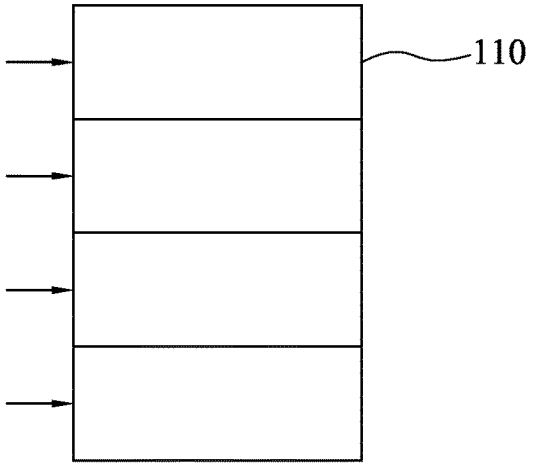
FIG. 1B
| | | | | |
|---|---|---|---|---|
| C1 | C2 | C3 | C4 | C5 |
| C6 | C7 | C8 | C9 | C10 |
| C11 | C12 | C13 | C14 | C15 |
| C16 | C17 | C18 | C19 | C20 |
| C21 | C22 | C23 | C24 | C25 |
120
FIG. 1C

| | | | | |
|---|---|---|---|---|
| 75 | 74 | 73 | 72 | 71 |
| 70 | 69 | 68 | 67 | 66 |
| 65 | 64 | 63 | 62 | 61 |
| 60 | 59 | 58 | 57 | 56 |
| 55 | 54 | 53 | 52 | 51 |

FIG. 10A

| | | | | |
|---|---|---|---|---|
| 50 | 49 | 48 | 47 | 46 |
| 45 | 44 | 43 | 42 | 41 |
| 40 | 39 | 38 | 37 | 36 |
| 35 | 34 | 33 | 32 | 31 |
| 30 | 29 | 28 | 27 | 26 |

FIG. 10B

| | | | | |
|---|---|---|---|---|
| 26 | 27 | 28 | 29 | 30 |
| 31 | 32 | 33 | 34 | 35 |
| 36 | 37 | 38 | 39 | 40 |
| 41 | 42 | 43 | 44 | 45 |
| 46 | 47 | 48 | 49 | 50 |

FIG. 10C

| | | | | |
|---|---|---|---|---|
| 51 | 52 | 53 | 54 | 55 |
| 56 | 57 | 58 | 59 | 60 |
| 61 | 62 | 63 | 64 | 65 |
| 66 | 67 | 68 | 69 | 70 |
| 71 | 72 | 73 | 74 | 75 |

FIG. 10D

| | | | | |
|---|---|---|---|---|
| 33 | 53 | 50 | 67 | 36 |
| 63 | 37 | 82 | 28 | 78 |
| 64 | 73 | 27 | 52 | 72 |
| 83 | 26 | 79 | 47 | 85 |
| 57 | 75 | 40 | 61 | 62 |

FIG. 12A

| | | | | |
|---|---|---|---|---|
| 34 | 58 | 84 | 81 | 38 |
| 77 | 74 | 59 | 48 | 68 |
| 65 | 29 | 30 | 49 | 80 |
| 35 | 51 | 60 | 71 | 66 |
| 39 | 70 | 31 | 76 | 32 |

FIG. 12B

LIQUID CRYSTAL DISPLAY DEVICE AND DISPLAY FLICKERING METHOD

RELATED APPLICATIONS

This application claims priority to China Application Serial Number 201410100287.5, filed Mar. 18, 2014 and China Application Serial Number 201510104054.7, filed Mar. 10, 2015, which are herein incorporated by reference.

BACKGROUND

This disclosure relates to a liquid crystal display (LCD) device and a display flickering method.

Description Of Related Art

Recently, display panels have been widely applied to various home appliances. With progress of operation time, a viewer's eyeballs move and focus vision continuously and uninterruptedly, thus causing the viewer's eyes to have various fatigue and discomfort problems accompanying with lower visual discrimination capability. With respect to the visual fatigue problem, conventional skills have ever provided concepts and applications related to a handy flicker. The handy flicker is a simple instrument for measuring the visual fatigue of a testee, in which the decrease of a critical fusion frequency (CFF) threshold is adopted to determine if the eyes actually have fatigue phenomenon.

However, the aforementioned detection method using a professional detecting instrument (such as a handy flicker) merely can display an image at a single flicker frequency but not at multiple frequencies at one time. It makes a viewer cannot easily learn the current fatigue level of his or her eyeballs by viewing the single flicker frequency of the displayed image. Accordingly, it is an issue desired to be resolved by those in this field regarding how to overcome this deficiency.

SUMMARY

In order to overcome the aforementioned problem, an aspect of this disclosure provides a liquid crystal device. The liquid crystal display device includes a time sequence control circuit, a display panel and a backlight source. The time sequence control circuit is configured to output a data signal and a control signal after receiving a first instruction signal. The display panel is configured to display at least one image by at least one frame display frequency according to the data signal. The backlight source is configured to illuminate the display panel by at least one backlight flicker frequency according to the control signal, in which the display panel displays the at least one image having at least one frame flicker frequency according to the at least one backlight flicker frequency and the at least one frame display frequency.

According to one embodiment, the display panel includes plural display regions corresponding to frame flicker frequencies. The display flickering method further includes: receiving an input signal by the time sequence control circuit; determining whether the input signal indicates that one of the display regions has a specific frequency range by the time sequence control circuit; if the time sequence control circuit determines that the input signal does not indicate that one of the display regions has the specific frequency range, the displays regions are driven to update the frame flicker frequencies, and the updated frame flicker frequencies are arranged in a random order.

In sum, comparing with the conventional skill, the present invention has apparent advantages and better effects, and can achieve technical progress and has a broad industrial application value. The LCD device and the display flickering method of the present invention can enable a user viewing the display panel to determine the current fatigue level of his or her eyes easily.

BRIEF DESCRIPTION OF THE DRAWINGS

The invention can be more fully understood by reading the following detailed description of the embodiment, with reference made to the accompanying drawings as follows:

FIG. 1A is a schematic diagram showing a backlight source 100 according to an embodiment of this invention;

FIG. 1B is a schematic diagram showing a backlight source 110 according to another embodiment of this invention;

FIG. 1C is a schematic diagram showing a backlight source 120 according to another embodiment of this invention;

FIG. 10A-FIG. 10D are schematic diagrams explaining the display flickering method according to the embodiment of this invention;

FIG. 12A-FIG. 12B are schematic diagrams for explaining the display flickering method according to the embodiment of this invention.

DETAILED DESCRIPTION

Figure 2:
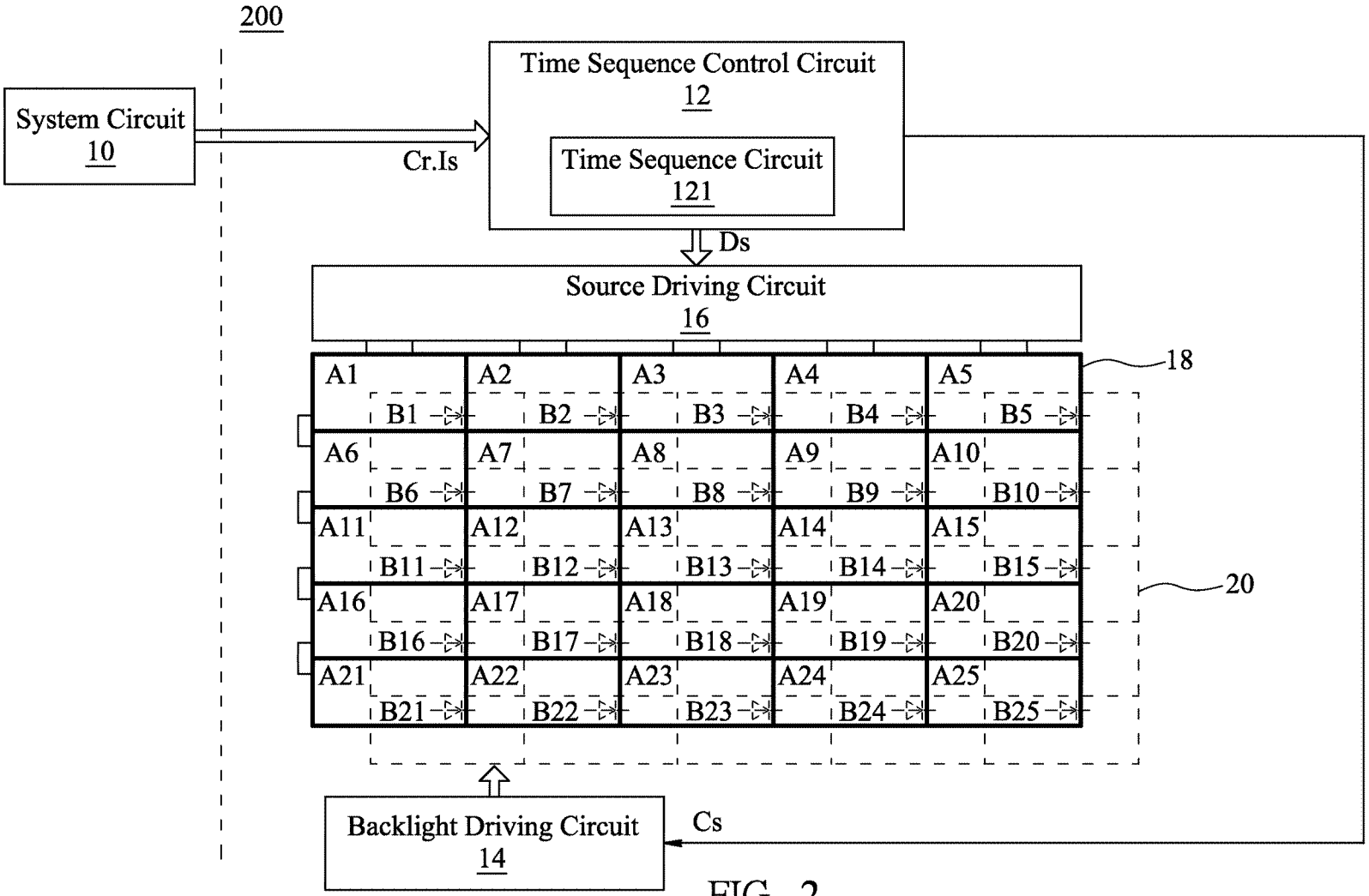
FIG. 2 is a schematic structural diagram showing a LCD device according to an embodiment of this invention.

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. For the convenience of understanding, identical units in the description are described with the same labels.

Although the terms "first," "second," etc., may be used herein to describe various elements, these elements should not be limited by these terms. These terms are used to distinguish one element from another.

The term "couple" or "connected" used in the specification means two or more components are physically or electrically connected to the each other directly or indirectly, or it may also mean interactions or interoperations of the two or more components.

Concretely speaking, a discrimination method using a CFF threshold mainly relies on the degree of decrease of the CFF threshold to determine a human eye fatigue level, in which flicker frequencies of three RGB primary colors can be simply controlled, and a viewer watches a flicker image at a fixed distance. The flicker image may show respective RGB colors simultaneously or in sequence. When an actual measurement is performed, the flicker frequency (generally designed to about 1 Hz-79 Hz) of a light source of a display panel is gradually increased until the viewer feels that the light source is not flickering, and then the flicker frequency at this critical point (F1) is referred to as the CFF threshold. On the other hand, the flicker frequency of the light source of the display panel is gradually decreased until the viewer feels that the light source is not flickering, and then the flicker frequency at this critical point (F2) is also referred to as the CFF threshold. The mathematical average of the flicker frequencies at the critical point (F1) and the critical point (F2) is used to represent the CFF value of the current measurement. Accordingly, the aforementioned visual fatigue detection method merely needs to determine the respective CFF values of the viewer before watching a screen and after watching the screen for a period of time. If the CFF values are decreasing (in general to about 0.5 Hz-6 Hz), it means that the eye fatigue level increases and a rest has to be taken.

Referring to FIGS. 1A to 1C, FIG. 1A is a schematic diagram showing a backlight source 100 according to an embodiment of this invention; FIG. 1B is a schematic diagram showing a backlight source 110 according to another embodiment of this invention; and FIG. 1C is a schematic diagram showing a backlight source 120 according to another embodiment of this invention. A display flickering method provided by this invention is applicable to different LCD panels, such as the backlight sources 100, 110 and 120. As shown in FIG. 1A, the backlight source 100 is a side light type backlight source or a straight down type backlight source, such as light emitting diode (LED) or Cold Cathode Fluorescent Lamp (CCFL), with an indivisible area al. Besides, as shown in FIG. 1B, the backlight source 110 is a side light type backlight source of one-dimensional divided region. For example, the backlight source 110 can be LED or CCFL, but not limited to the side light type backlight source. In one embodiment, a side light source may be provided at any one side of the backlight source 110 to divide the display panel into plural regions. For example, the side light source is provided from the left side towards the right side of the backlight source 110, and the backlight source 110 is divided into four regions. Further, as shown in FIG. 1C, the backlight source 120 can be any direct-light LED LCD panel, and may include plural display regions arranged in an array, such as the display regions C1-C25 shown in FIG. 1C.

Referring to FIG. 2, FIG. 2 is a schematic structural diagram showing a LCD device 200 according to an embodiment of this invention. In FIG. 2, the LCD device 200 includes a time sequence control circuit 12, a display panel 18 and a backlight source 20. The backlight source 20 includes backlight units B1-B25. The time sequence control circuit 12 is configured to output a data signal Ds and a control signal Cs after receiving a first instruction signal Is. The display panel 18 is configured to display an image by at least one frame display frequency according to the data signal Ds. The backlight source 20 is configured to illuminate the display panel 18 by at least one backlight flicker frequency according to the control signal Cs, in which the display panel 18 displays the at least one image having at least one frame flicker frequency according to the at least one backlight flicker frequency and the at least one frame display frequency. Accordingly, the display panel 18 can display the least one frame flicker frequency simultaneously for allowing a user to perform a visual fatigue test.

In some embodiments, in FIG. 2, the LCD device 200 may further include a source driving circuit 16 and a backlight driving circuit 14, and the time sequence control circuit 12 may further include a time sequence circuit 121. Besides, the time sequence control circuit 12 may be connected to a system circuit 10. The time sequence circuit 121 is configured to receive the instruction signal Is from the system circuit 10, and output the data signal Ds to the source driving circuit 16 and the control signal Cs to the backlight driving circuit 14 according to the instruction signal Is.

Further, the display panel 18 may include at least one display region, in which the at least one frame flicker frequency $f_{An}$ corresponds to a corresponding display region of the at least one display region.

For example, in FIG. 2, the display panel 18 can be divided into twenty-five display regions A1-A25, i.e. when an image is displayed on the screen, the display regions A1-A25 can be corresponding to twenty-five frame display frequencies $f_{An}$ (n=1, . . . 25). Besides, the backlight source 20 may include plural backlight units B1-B25 corresponding to different backlight flicker frequencies $f_{Bn}$ (n=1, . . . 25), thereby forming twenty-five regions of which the backlight flicker frequencies $f_{Bn}$ are adjustable. The display regions A1-A25 are aligned with the backlight units B1-B25 respectively. For example, the display region A1 is aligned with the backlight unit B1, the display region A2 is aligned with the backlight unit B2, and so on. Therefore, by interlacing or mixing the display regions A1-A25 having the frame display frequencies $f_{An}$ and the backlight units B1-B25 having the backlight flicker frequencies $f_{Bn}$, the viewer can sense twenty-five frame flicker frequencies $f_{Cn}$ on the same displayed image in a unit of time when viewing the full image on the display panel.

More specifically, as shown in FIG. 2, the system circuit 10 issues an instruction signal Is, and a visual fatigue test scheme is activated by the instruction signal Is. The time sequence control circuit 12 receives the instruction signal Is, and outputs the data signal Ds to the source driving circuit 16 and the control signal Cs to the backlight driving circuit 14. The data signal Ds has a frame display frequency $f_{An}$, for example, $f_{A1}$ represents the frame display frequency of the display region A1, $f_{A2}$ represents the frame display frequency of the display region A2, and so on. The control signal Cs has a backlight flicker frequency $f_{Bn}$, for example, $f_{B1}$ represents the backlight flicker frequency of the backlight unit B1, $f_{B2}$ represents the backlight flicker frequency of the backlight unit B2, and so on. Besides, in another embodiment, the backlight flicker frequency can be about a value of 0, thereby enabling the backlight source 20 to persistently illuminate the display panel 18.

Accordingly, the aforementioned LCD device 200 can generate the frame flicker frequency $f_{Cn}$ in each display region for determining the human eye fatigue level.

In one embodiment, under normal operation, the frame display frequency $f_{An}$ can be 60 Hz, 120 Hz, 240 Hz, 480 Hz or another frequency, and the data signal Ds can be adjusted by the time sequence circuit 121 to gradually decrease or increase the frame display frequency in time. Besides, the initial backlight flicker frequency $f_{Bn}$ can be in a range from 200 Hz to 2 kHz, and the control signal can be outputted from the time sequence circuit 121 to gradually decrease the backlight flicker frequency $f_{Bn}$ in time, thereby effectively collaborating with the frame display frequency to generate the frame flicker frequency $f_{Cn}$ required for determining visual fatigue.

Because different regions of the display panel 18 are corresponding to different frame flicker frequencies, the viewer only needs to select the regions of the display panel 18 which are comfortable to human eyes after activating a visual fatigue test, and the current human eye fatigue level can be further determined. The visual fatigue test will be explained later.

Further, in another embodiment, the source driving circuit 16 can drive the display panel 18 to change times of bright frames and dark frames alternately displayed in time in the at least one display region according to the data signal Ds, thereby adjusting the frame display frequency $f_{An}$.

Figure 3:
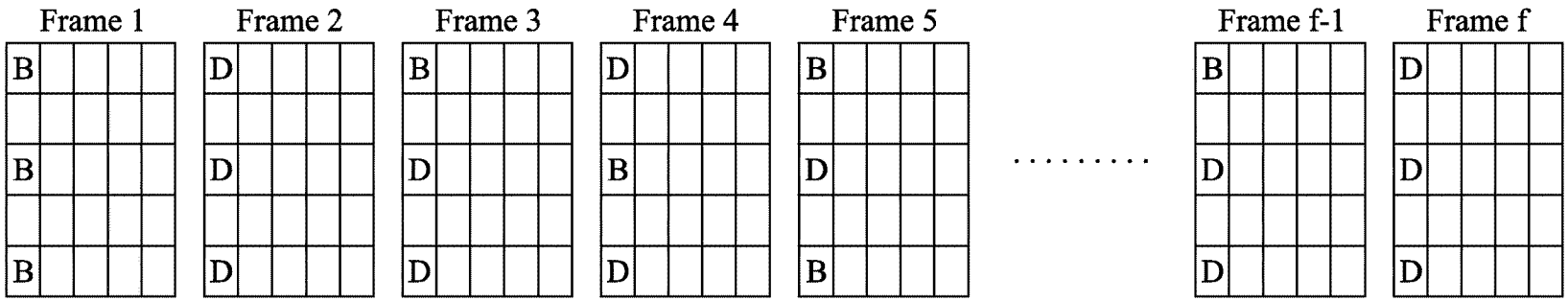
FIG. 3 is a schematic diagram of changing times of bright frames and dark frames alternately displayed in time in at least one display region according to an embodiment of this invention.

For example, referring to FIG. 3, FIG. 3 is a schematic diagram of changing times of bright frames and dark frames alternately displayed in time in the at least one display region according to an embodiment of this invention. In this embodiment, the display panel 18 is divided into twenty-five display regions. In the following description, the first display region A1, the eleventh display region A11 and the twenty-first display region A21 are used for explanation. The initial image of the display panel 18 can be composed of f frames, and the operating frequency of display panel 18 can be 60 Hz, 120 Hz, 240 Hz, 480 Hz or another frequency. In FIG. 3, "B" (Brightness) represents that the corresponding display region is a bight frame, and "D" (Darkness) represents that the corresponding display region is a dark frame. The first display region A1 is corresponding to the frame display frequency $f_{A1}$, and the frame display frequency $f_{A1}$ indicates displaying one bright frame in every two frames, and thus the frame display frequency can reach 30 Hz under the operating frequency of 60 Hz and reach 60 Hz under the operating frequency of 120 Hz. The eleventh display region A11 is corresponding to the frame display frequency $f_{A11}$, and the frame display frequency $f_{A11}$ indicates displaying one bright frame in every three frames, and thus the frame display frequency can reach 20 Hz under the operating frequency of 60 Hz. The twenty-first display region A21 is corresponding to the frame display frequency $f_{A21}$, and the frame display frequency $f_{A21}$ indicates displaying one bright frame in every four frames, and thus the frame display frequency can reach 15 Hz under the operating frequency of 60 Hz. Accordingly, the frame display frequency $f_{An}$ can be adjusted by changing the times of bright frames and dark frames alternately displayed on the display screen.

Hereinafter, Table 1 and Table 2 are used for schematically explaining and showing the frame display frequency $f_{An}$ under different operating frequencies, in which one bright frame are displayed in every j frames.

TABLE 1

| Operating Frequency (Hz) | Frame Display Frequency $f_{An}$ (Hz) | | | | | | | | |
|---|---|---|---|---|---|---|---|---|---|
| | j = 1 | j = 2 | j = 3 | j = 4 | j = 5 | j = 6 | j = 8 | j = 10 | j = 12 |
| 60 | 60 | 30 | 20 | 15 | 12 | 10 | x | 6 | 5 |
| 120 | 120 | 60 | 40 | 30 | 24 | 20 | 15 | 12 | 10 |
| 240 | 240 | 120 | 80 | 60 | 48 | 40 | 30 | 24 | 20 |
| 480 | 480 | 240 | 160 | 120 | 96 | 80 | 60 | 48 | 40 |

TABLE 2

| Operating Frequency (Hz) | Frame Display Frequency $f_{An}$ (Hz) | | | | | | | | | |
|---|---|---|---|---|---|---|---|---|---|---|
| | j = 15 | j = 16 | j = 20 | j = 30 | j = 40 | j = 60 | j = 80 | j = 120 | j = 240 | j = 480 |
| 60 | 4 | x | 3 | 2 | x | 1 | x | x | x | x |
| 120 | 8 | x | 6 | 4 | 3 | 2 | x | 1 | x | x |
| 240 | 16 | 15 | 12 | 8 | 6 | 4 | 3 | 2 | 1 | x |
| 480 | 32 | 30 | 24 | 16 | 12 | 8 | 6 | 4 | 2 | 1 |

It can be known from Table 1 and Table 2 that, under the operating frequency of 60 Hz, if the bright frame in a certain display region is displayed once in every 6 frames (j=6), the corresponding frame display frequency is 10 Hz, and if the bright frame in a certain display region is displayed once in every 15 frames (j=15), the corresponding frame display frequency is 4 Hz. Similarly, under the operating frequency of 120 Hz, if the bright frame in a certain display region is displayed once in every 5 frames (j=5), the corresponding frame display frequency is 24 Hz, and if the bright frame in a certain display region is displayed once in every 12 frames (j=12), the corresponding frame display frequency is 10 Hz. Therefore, the frame display frequency $f_{An}$ can be adjusted by changing the times of bright frames and dark frames alternately displayed on the display screen, thus achieving visual flickering sensations with different frequencies. Further, in another embodiment, the frame display frequency fAn can be adjusted by changing a continuous period of the bright frame displayed in the display region.

Figure 4:
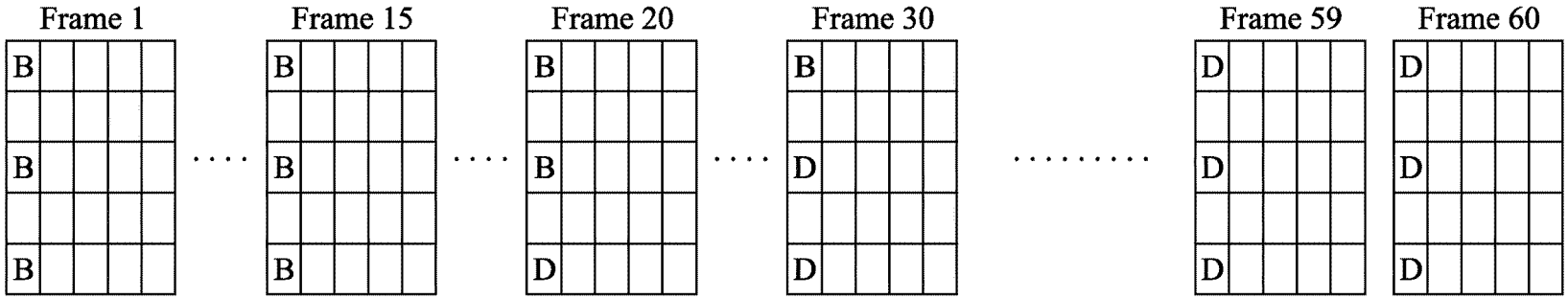
FIG. 4 is a schematic diagram of changing a continuous period of a bright frame displayed in at least one display region according to an embodiment of this invention.

For example, referring to FIG. 4, FIG. 4 is a schematic diagram of changing a continuous period of a bright frame displayed in the at least one display region according to an embodiment of this invention. In this embodiment, the operating frequency of the display panel 18 is 60 Hz, and the first thirty frames in the first display region A1 all are bright frames, and the last thirty frames in the first display region A1 all are dark frames, and thus the frame display frequency of 30 Hz is achieved. Similarly, with the first twenty bright frames in the eleventh display region A11 and the last forty dark frames in the eleventh display region A11, the frame display frequency of 20 Hz is achieved; and with the first fifteen bright frames in the twenty-first display region A21 and the last fifty-five dark frames in the twenty-first display region A21, the frame display frequency of 15 Hz is achieved. Thereafter, the adjusted frame display frequency $f_{An}$ (such as the frame display frequency of 30 Hz in the first display region A1; the frame display frequency of 20 Hz in the eleventh display region A11; and the frame display frequency of 15 Hz in the twenty-first display region A21) is mixed with the corresponding backlight flicker frequency $f_{Bn}$ to obtain the frame flicker frequency $f_{Cn}$. Accordingly, the frame display frequency can be adjusted by changing the continuous period of the bright frame displayed in the display region, thus achieving visual flickering sensations with different frequencies.

Figure 5:
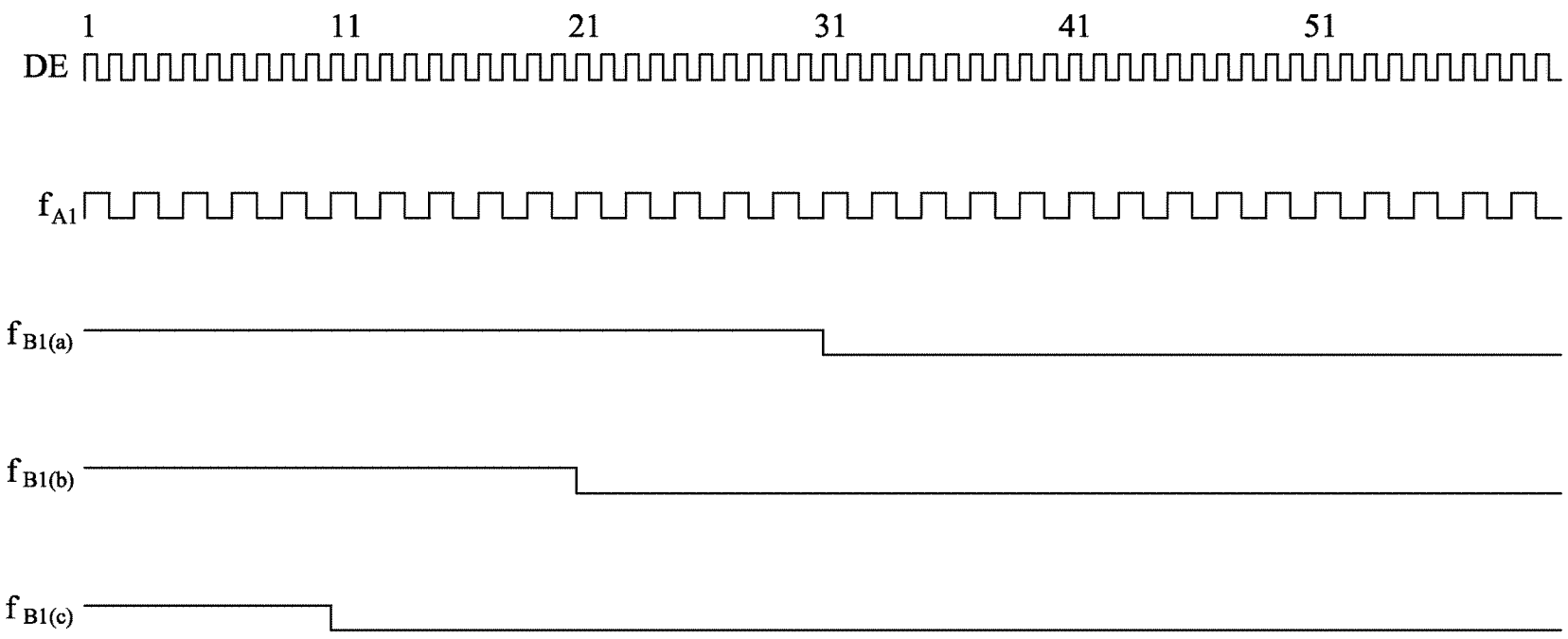
FIG. 5 is a schematic diagram of adjusting at least one backlight flicker frequency of a display panel according to an embodiment of this invention.

In one embodiment, the time sequence circuit 121 outputs the control signal to the backlight driving circuit 14 in accordance with an operation period, such that the backlight driving circuit 14 can control backlight on-time of each of the backlight units B1-B25 corresponding to the display regions A1-A25, thereby adjusting the corresponding backlight flicker frequencies $f_{Bn}$ to achieve different fine degrees of flickering. Accordingly, the display panel 18 can display the image having the corresponding frame flicker frequencies $f_{Cn}$ in accordance with the backlight flicker frequencies $f_{Bn}$ and the frame display frequencies $f_{An}$. Concretely speaking, referring to FIG. 5, FIG. 5 is a schematic diagram of adjusting the backlight flicker frequencies of the display panel according to an embodiment of this invention. As shown in FIG. 5, pulse DE presents Driver Enabled signal. In some embodiments, the backlight flicker frequencies $f_{Bn}$ can be adjusted to different frequencies (for example, by adjusting the on time of the backlight source), such as $f_{B1(a)}$, $f_{B1(b)}$ or $f_{B1(c)}$, and the different backlight flicker frequencies $f_{Bn}$ can be mixed with the frame display frequencies $f_{An}$ respectively to show different frame flicker frequencies $f_{Cn}$ on the display screen. In some embodiments, the frame display frequency $f_{A1}$ is 30 Hz, and the frame flicker frequency $f_{C1(a)}$ of 15 Hz can be obtained under the condition that the backlight flicker frequency $f_{B1(a)}$ is equal to ½ of the operating frequency. Similarly, under the conditions that the backlight flicker frequency $f_{B1(a)}$ is equal to ⅓ of the operating frequency and ⅙ of the operating frequency, the frame flicker frequency $f_{C1(b)}$ of 10 Hz and the frame flicker frequency $f_{C1(c)}$ of 5 Hz can be obtained In another embodiment, the time sequence circuit 121 outputs the control signal to the backlight driving circuit 14 in accordance with a backlight display period, such that the backlight driving circuit 14 can control backlight on-time of each of the backlight units B1-B25 corresponding to the display regions A1-A25, thereby adjusting the corresponding backlight flicker frequencies $f_{Bn}$ to achieve different fine degrees of flickering. Accordingly, the display panel 18 can display the image having the corresponding frame flicker frequencies $f_{cn}$ in accordance with the backlight flicker frequencies $f_{Bn}$ and the frame display frequencies $f_{An}$.

Figure 6:
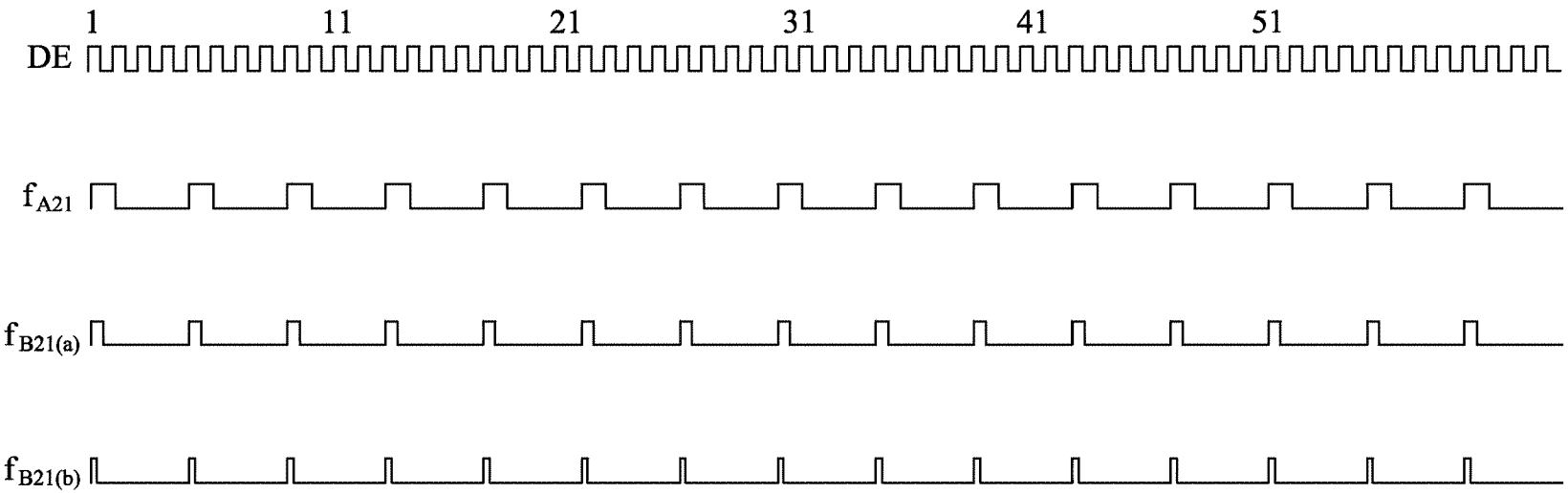
FIG. 6 is a schematic diagram of adjusting at least one backlight flicker frequency of a display panel according to another embodiment of this invention.

For example, referring to FIG. 6, FIG. 6 is a schematic diagram of adjusting the at least one backlight flicker frequency of a display panel according to another embodiment of this invention. In FIG. 6, under the condition of the frame display frequency $f_{A21}$ of 15 Hz, when the on-time corresponding to the backlight flicker frequency $f_{B21(a)}$ is ½ of the display period of the bright frame, the backlight flicker frequency $f_{B21(a)}$ and the frame display frequency $f_{A21}$ can be mixed to obtain the frame flicker frequency $f_{C21(a)}$ of 7.5 Hz. Similarly, when the on-time corresponding to the backlight flicker frequency $f_{B21(b)}$ is ⅓ of the display period of the bright frame, the backlight flicker frequency $f_{B21(b)}$ and the frame display frequency $f_{A21}$ can be mixed to obtain the frame flicker frequency $f_{C21(b)}$ of 5 Hz, in which the backlight flicker frequency $f_{B21(b)}$ and the frame display frequency $f_{A21}$ are adjusted synchronously.

Figure 7:
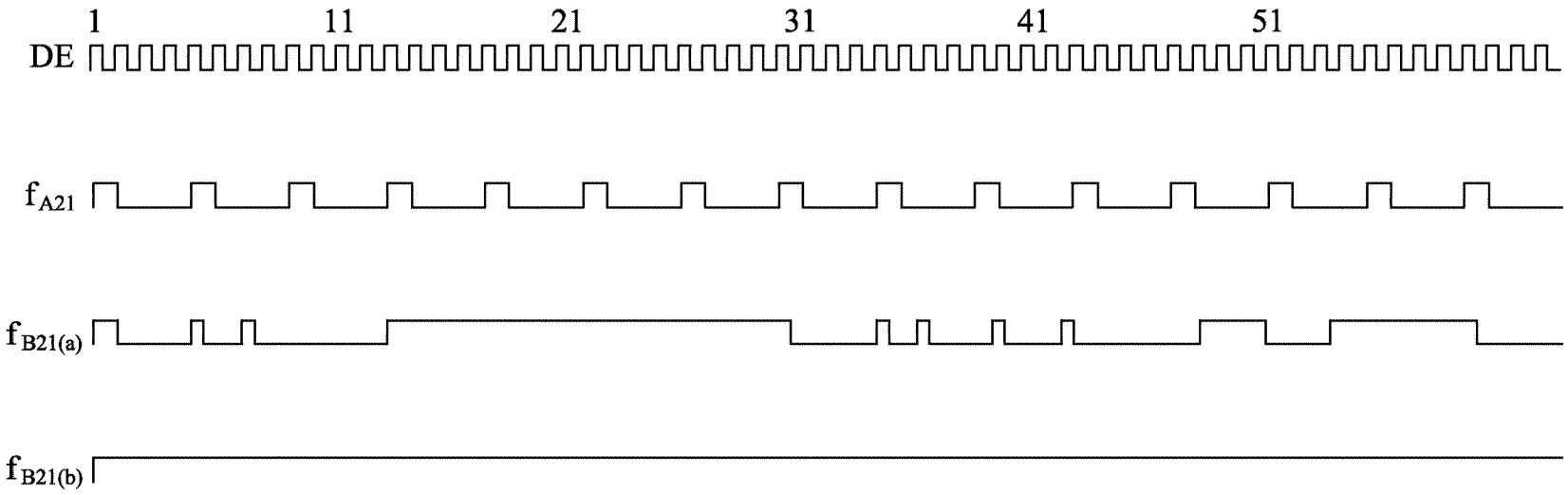
FIG. 7 is a schematic diagram of adjusting at least one backlight flicker frequency of a display panel according to another embodiment of this invention.

Further, referring to FIG. 7, FIG. 7 is a schematic diagram of adjusting the at least one backlight flicker frequency of the display panel according to another embodiment of this invention. In FIG. 7, the backlight flicker frequency $f_{B21(a)}$ shows an always-on state, meaning that the backlight flicker frequency $f_{B21(a)}$ is about a value of 0, thereby enabling the backlight source to persistently illuminate the display panel. In another embodiment, the backlight flicker frequency $f_{B21(b)}$ and the frame display frequency $f_{A21}$ are adjusted asynchronously.

Hereinafter, this invention will be explained in more detail accompanying with a display flickering method shown in FIG. 8, but this invention is not limited to the following embodiments.

Figure 8:
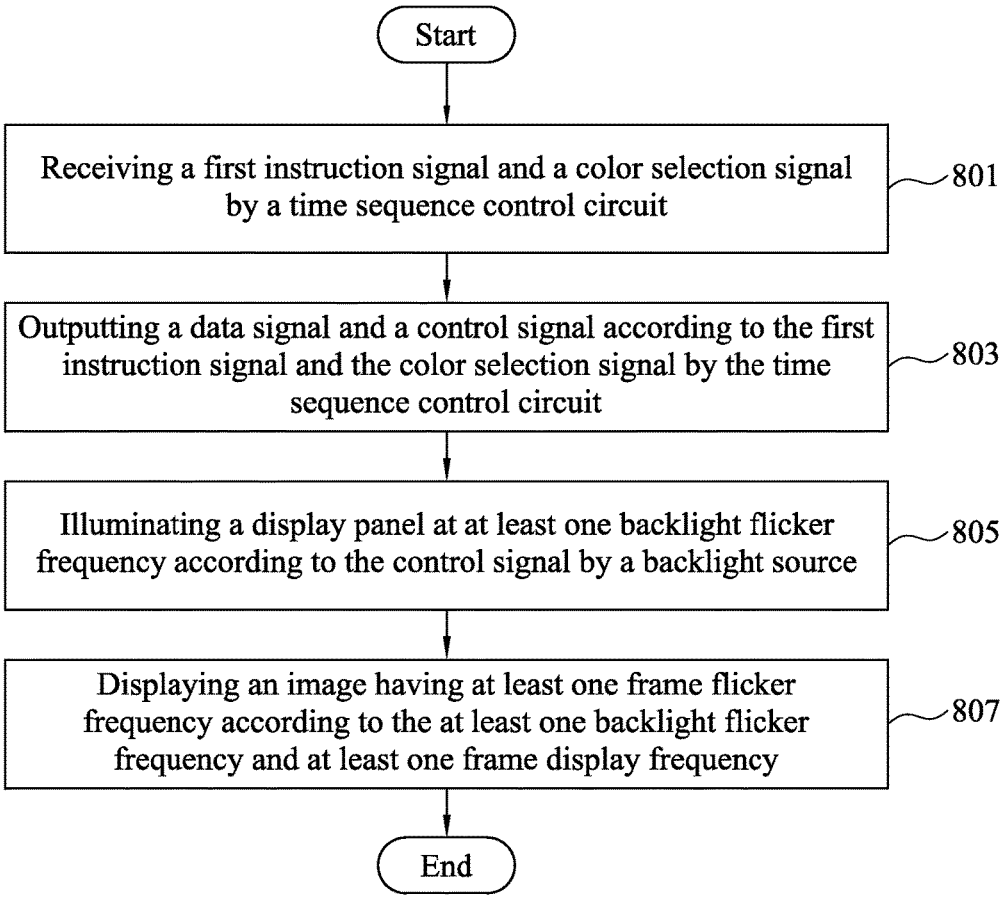
FIG. 8 is a flow chart showing a display flickering method according to an embodiment of this invention.

FIG. 8 is a flow chart showing a display flickering method according to an embodiment of this invention. The display flickering method shown in FIG. 8 is applicable to the display device 200 shown in FIG. 2, but is not limited thereto. For the convenience of explanation, the display flickering method described below is explained accompanying with the display device 200 shown in FIG. 2.

In step 801, a first instruction signal Is and a color selection signal Cr are received by the time sequence control circuit 12. For example, the time sequence control circuit 12 receives the first instruction signal Is and the color selection signal Cr which are issued by a user using a remote controller. The first instruction signal Is indicates that the user desires to perform a visual fatigue test, and the color selection signal Cr indicates a color of an image desired to be used by the user for performing the visual fatigue test, in which the color of the image may be one of three primary colors (red, green or blue) or an arbitrary color formed by mixing three primary colors. In this step, the user may select a single-color test or multiple tests sequentially displaying three primary colors.

Thereafter, in step 803, the time sequence control circuit 12 outputs a data signal Ds and a control signal Cs according to the first instruction signal Is and the color selection signal Cr, and the display panel 18 displays the image by at least one frame display frequency $f_{An}$ according to the data signal Ds, in which the first instruction signal Is can be inputted by using an external push button, an external system board or a remote controller to control an on-screen display (OSD) interface of a television, or can be generated at a fixed time by the time sequence control circuit 12, in which the user may artificially control or set up the fixed time.

In step 805, the backlight source 20 is used to illuminate the display panel 18 by at least one backlight flicker frequency $f_{Bn}$ according to the control signal Cs.

In step 807, the display panel 18 displays the at least one image having at least one frame flicker frequency $f_{Cn}$ according to the at least one backlight flicker frequency $f_{Bn}$ and the at least one frame display frequency $f_{An}$.

Accordingly, the display panel 18 can display the image having the corresponding frame flicker frequency $f_{Cn}$ according to the corresponding backlight flicker frequency $f_{Bn}$ and the corresponding frame display frequency $f_{An}$. Therefore, by adjusting the backlight flicker frequency $f_{Bn}$ or the frame display frequency $f_{An}$, for example, by decreasing the frequency ($f_{An}$ or $f_{Bn}$) to make the displayed image look coarser, or by increasing the frequency ($f_{An}$ or $f_{Bn}$) to make the displayed image look finer, the frame flicker frequency $f_{Cn}$ can be effectively obtained for determining if human eyes are fatigued.

Figure 9A:
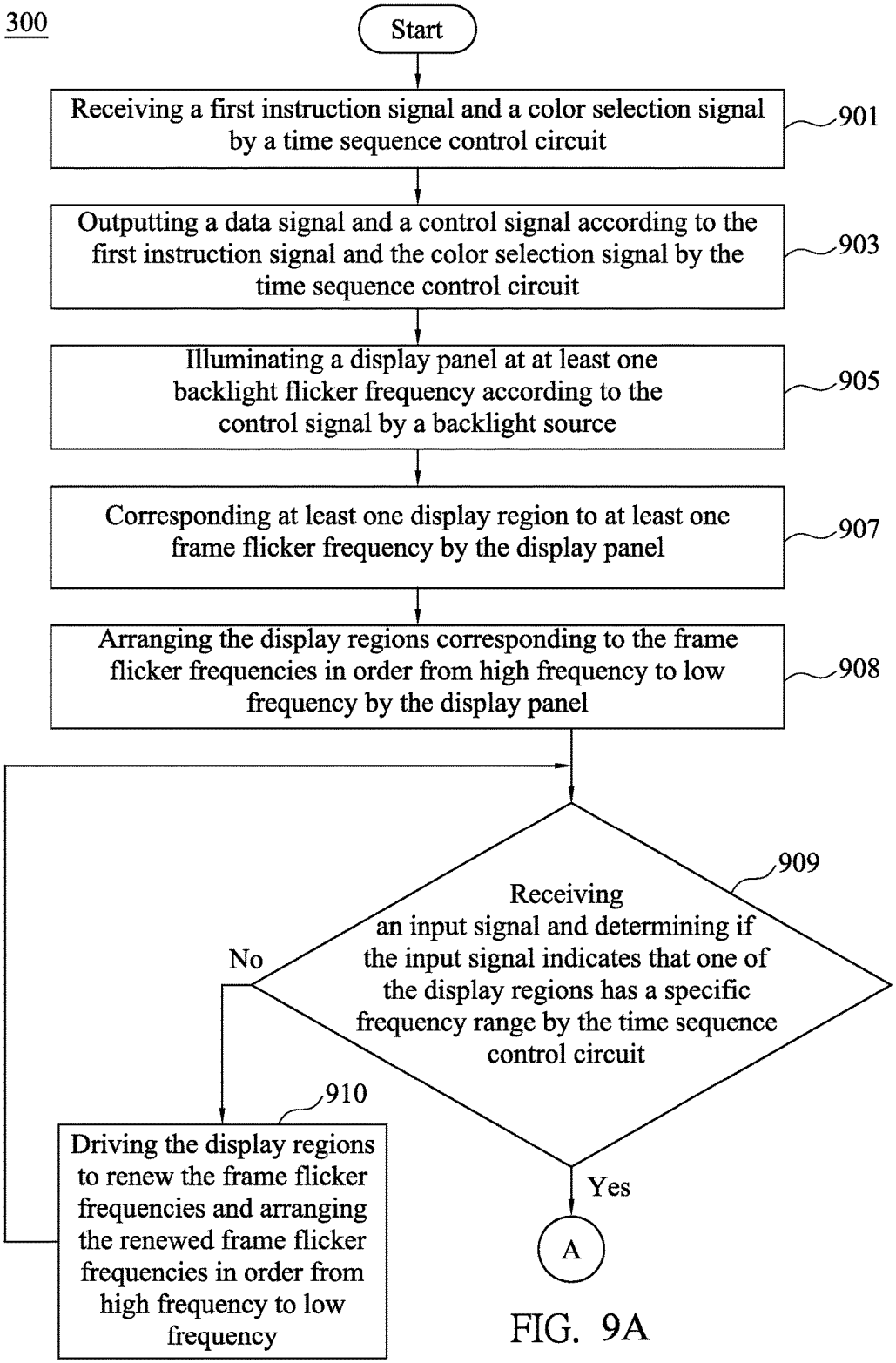
FIG. 9A-FIG. 9B constitute a flow chart showing a display flickering method according to another embodiment of this invention.

In another embodiment, the display panel 18 includes plural display regions, in which the corresponding frame display frequencies $f_{An}$ are adopted in the display regions. Referring to FIG. 9A-FIG. 9B and FIG. 10A-FIG. 10D, FIG. 9A-FIG. 9B constitute a flow chart showing a display flickering method according to another embodiment of this invention, and FIG. 10A-FIG. 10D schematic diagrams explaining the display flickering method according to the embodiment of this invention. In FIG. 9A, steps 901, 903 and 905 are the same as steps 801, 803 and 805 shown in FIG. 8, and thus are not described again.

Figure 9B:
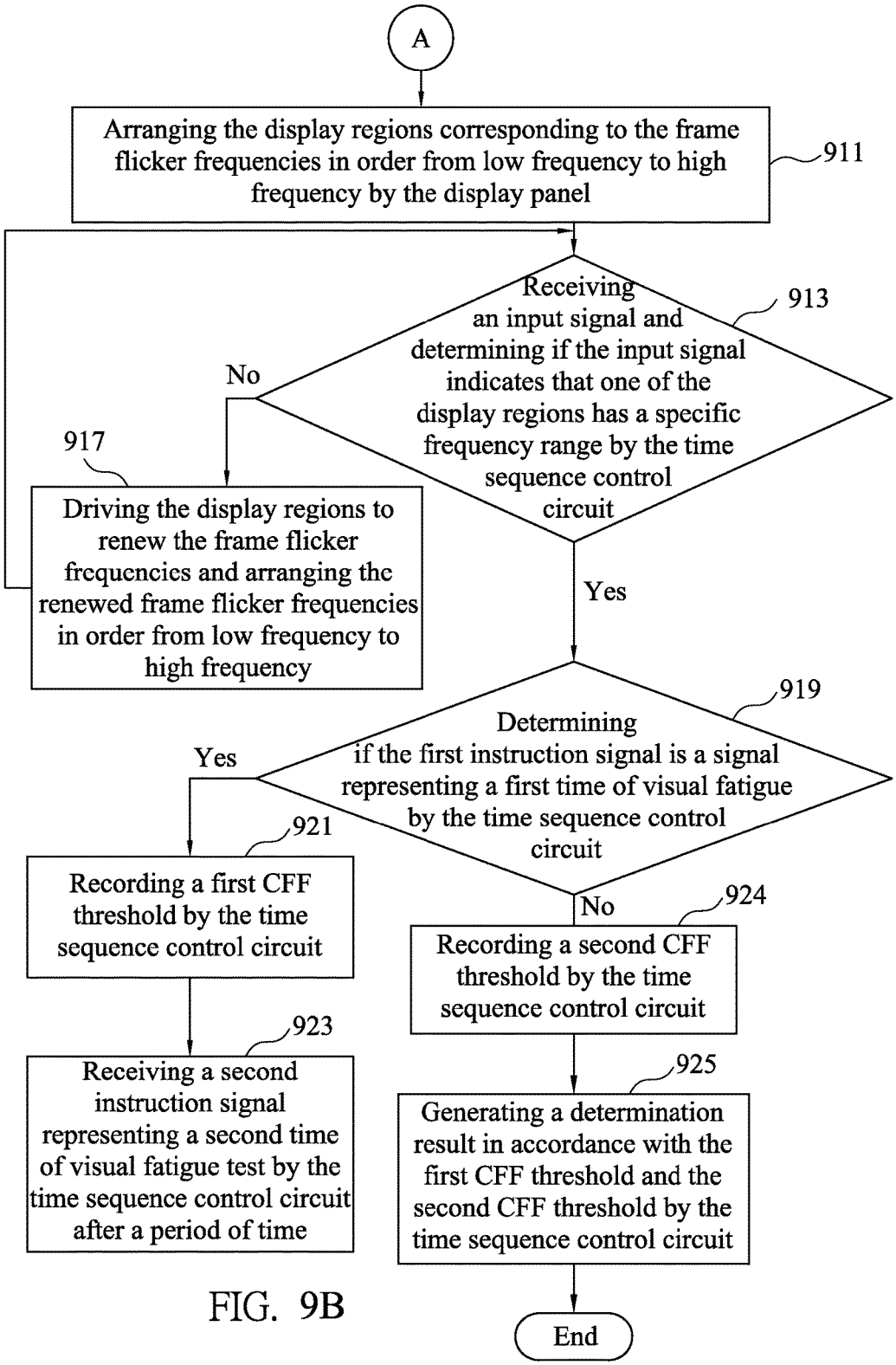

In FIG. 9A-FIG. 9B, the display flickering method includes the following steps. In step 907, the display panel 18 corresponds the at least one display region to the at least one frame flicker frequency.

In step 908, the display panel 18 arranges the display regions corresponding to the frame flicker frequencies in order from high frequency to low frequency. As shown in FIG. 10A, the frame flicker frequency in the display region at the upper-left corner is 75 Hz, and that in its right adjacent region is 74 Hz; and the frame flicker frequency in the display region at the lower-right corner is the lowest, 51 Hz. Apparently, the display regions are arranged in order from the highest frame flicker frequency to the lowest frame flicker frequency.

Then, in step 909, the time sequence control circuit 12 is used to receive an input signal and to determine if the input signal indicates that one of the display regions has a specific frequency range. When it is determined that the input signal does not indicate that one of the display regions has the specific frequency range, step 910 is performed.

For example, the user sends an input signal to the time sequence control circuit 12 by using a remote controller. At this moment, if the time sequence control circuit 12 determines that the input signal does not indicate that the one of the display regions is a visually comfortable area (or a non-flickering area), it means that the display regions do not have the specific frequency range acceptable to the user, and thus step 910 is performed.

In step 910, the display regions are driven to update the frame flicker frequencies, and as shown in FIG. 10B, and the display panel 18 arranges the updated frame flicker frequencies in order from high frequency to low frequency. Then, step 909 is performed again. In another embodiment, the updated frame flicker frequencies can be partially the same as the original frame flicker frequencies. And, the updated frame flicker frequencies can be arranged in order from high frequency to low frequency or from low frequency to high frequency.

On the contrary, in step 909, when the time sequence control circuit 12 determines that the input signal indicates that one of the display regions has the specific frequency range, it represents that there is a visually comfortable area (or a non-flickering area) among the display regions, meaning that the display regions have the specific frequency range acceptable to the user, and step 911 is performed.

In step 911, the display panel 18 arranges the display regions corresponding to the frame flicker frequencies in order from low frequency to high frequency. As shown in FIG. 10C, the frame flicker frequency in the display region at the upper-left corner is 26 Hz, and the frame flicker frequency in its right adjacent region is 27 Hz; and the frame flicker frequency in the display region at the lower-right corner is the lowest, 50 Hz. Apparently, the display regions are arranged in order from the lowest frame flicker frequency to the highest frame flicker frequency.

Then, in step 913, the time sequence control circuit 12 is used to receive an input signal and to determine if the input signal indicates that one of the display regions has a specific frequency range. When it is determined that the input signal does not indicate that one of the display regions has the specific frequency range, step 917 is performed.

For example, the user sends an input signal to the time sequence control circuit 12 again by using a remote controller. At this moment, if the time sequence control circuit 12 determines that the input signal indicate that none of the display regions is a visually comfortable area (or a non-flickering area), it means that the display regions do not have the specific frequency range acceptable to the user, and thus step 917 is performed.

In step 917, the display regions are driven to update the frame flicker frequencies, and as shown in FIG. 10D, and the display panel 18 arranges the updated frame flicker frequencies in order from low frequency to high frequency. Then, step 913 is performed again. In another embodiment, the updated frame flicker frequencies can be partially the same as the original frame flicker frequencies. And, the updated frame flicker frequencies can be arranged in order from high frequency to low frequency or from low frequency to high frequency.

On the contrary, in step 913, when the time sequence control circuit 12 determines that the input signal indicates that one of the display regions has the specific frequency range, step 919 is performed.

In step 919, the time sequence control circuit 12 is used to determine if the first instruction signal is a signal representing a first time of visual fatigue test. When the time sequence control circuit 12 receives the first instruction signal representing the first time of visual fatigue test, step 921 is performed.

In step 921, the time sequence control circuit 12 is used to record a first CFF threshold and control the at least one frame display frequency $f_{An}$ and the backlight source 20, thereby enabling the display panel 18 to display the image having the frame flicker frequency which has been adjusted once, and step 923 is performed.

The first CFF threshold can be an average of the frequency ranges selected by the user. For example, the frequency range selected by the user in step 909 is about 60 Hz, and the frequency range selected by the user in step 913 is about 70 Hz, and then first CFF threshold is 65 Hz, representing that the user does not feel uncomfortable when viewing the display region adopting the frame flicker frequency of 65 Hz.

In step 923, after a period of time, the time sequence control circuit 12 is used to receive a second instruction signal (not shown) representing a second time of visual fatigue test, and then step 905 is performed again for using the backlight source 20 to illuminate the display panel 18 by at least one backlight flicker frequency $f_{Bn}$ according to the control signal Cs which is generated according to the second instruction signal, such that the display panel 18 displays the image having the frame flicker frequency $f_{Cn}$ which has been adjusted twice. At this moment, the steps 905-919 which are performed again can be considered as the second time of visual fatigue test. After the second time of visual fatigue test is completed, in the step 919, which is performed at the second time, when the time sequence control circuit 12 determines that the second instruction signal is not a signal representing the first time of visual fatigue test, step 924 is performed.

In step 924, the time sequence control circuit 12 is used to record a second CFF threshold. Similar to the first CFF threshold, the second CFF threshold can be such as 55 Hz, and the computation of the second CFF threshold can be the same as that of the first CFF threshold and is not described again herein.

Thereafter, in step 925, the time sequence control circuit 12 is used to generate a determination result in accordance with the first CFF threshold and the second CFF threshold. For example, the determination result is a result obtained by comparing the first CFF threshold of 65 Hz with the second CFF threshold 55 Hz. In this example, because the second CFF threshold of 55 Hz is smaller than the first CFF threshold of 65 Hz, it is determined that the user has visual fatigue. Otherwise, in another example, the second CFF threshold is not smaller than the first CFF threshold, and thus it is determined that the user does not have visual fatigue.

In another embodiment, for achieving the actual system design with more flexibility, the aforementioned steps 908, 909 and 910 can be swapped with the steps 911, 913 and 917, or the method may only perform one set of steps. For example, only the set of steps 908/909/910 or the set of steps 911/913/917 is performed, so as to reduce the system computation amount.

Figure 11A:
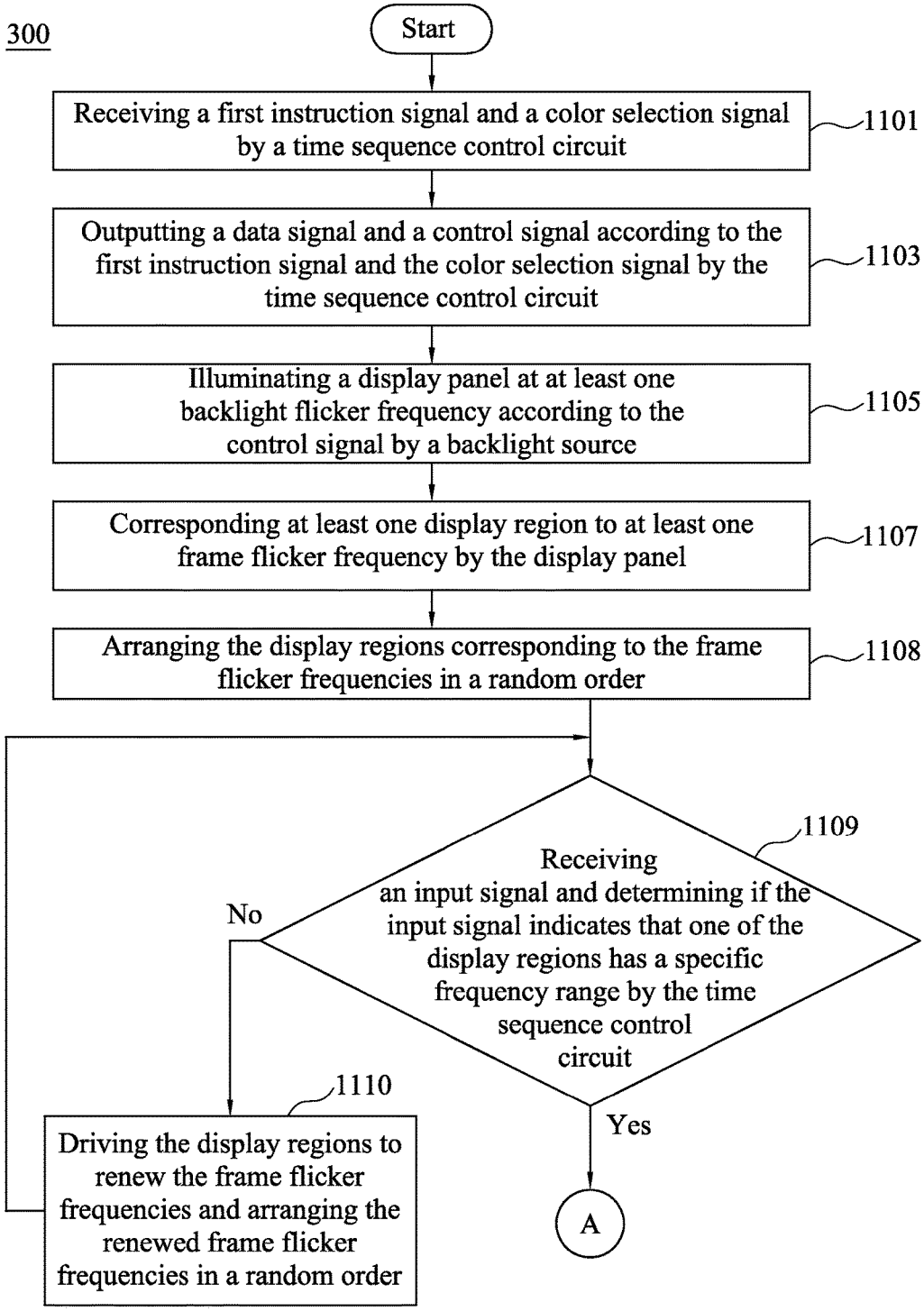
FIG. 11A-FIG. 11B constitute a flow chart showing a display flickering method according to another embodiment of this invention.
Figure 11B:
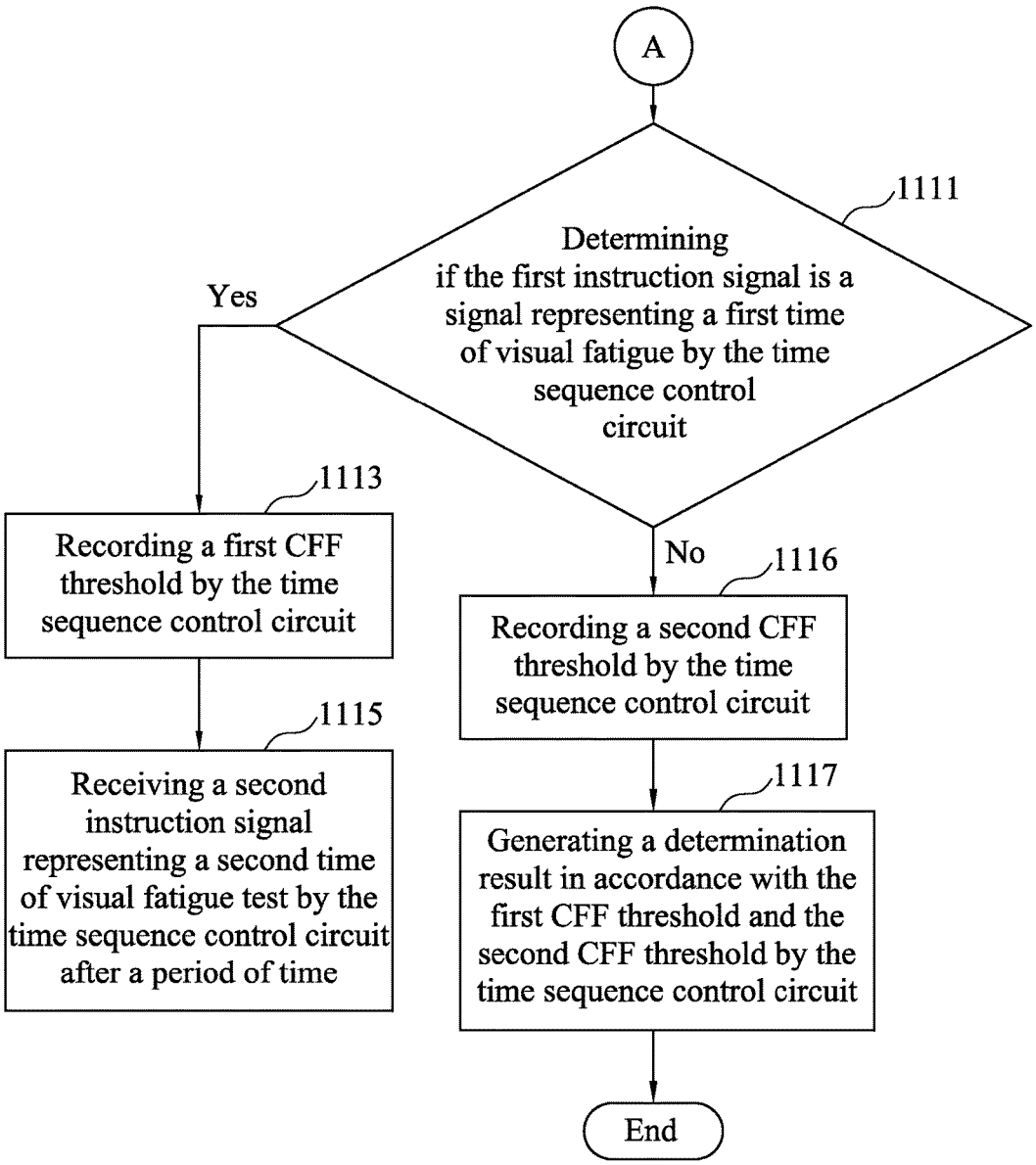

Besides, in one embodiment, the steps 908, 909, 910, 911, 913 and 917 can be briefly replaced by steps 1108, 1109 and 1110 shown in FIG. 11A-FIG. 11B. Referring to FIG. 11A-FIG. 11B and FIG. 12A-FIG. 12B, FIG. 11A-FIG. 11B constitute a flow chart showing a display flickering method according to another embodiment of this invention, and FIG. 12A-FIG. 12B are schematic diagrams for explaining the display flickering method according to the embodiment of this invention. In step 1108, the display panel 18 arranges the display regions corresponding to the frame flicker frequencies in a random order, as shown in FIG. 12A.

In step 1109, the time sequence control circuit 12 is used to receive an input signal and to determine if the display regions have a specific frequency range. When it is determined that the input signal does not indicate that one of the display regions has the specific frequency range, step 1110 is performed.

In step 1110, the display regions are driven to update the frame flicker frequencies, and the display panel 18 arranges the updated frame flicker frequencies in a random order, as shown in FIG. 12B. Then, step 1109 is performed again. Further, steps 1101, 1103, 1105, 1107, 1111, 1113, 1115, 1116 and 1117 shown in FIG. 11A-FIG. 11B are the same as the steps 901, 903, 905, 907, 919, 921, 923, 924 and 925 shown in FIG. 9A-FIG. 9B, and thus are not described again herein.

According to the aforementioned contents of this disclosure, the time sequence control circuit 12 can be used to change the data signal and the control signal so as to change the frame flicker frequency without needing to increase hardware circuit design cost. The present invention can actively perform a visual fatigue test by corresponding different display regions of the display panel to images having different frame flicker frequencies, thereby shortening the length of time for performing the visual fatigue test, such that a viewer may learn the current fatigue level of his or her eyes easily to enhance his or her self-consciousness to protect his or her eyes.

Although the present disclosure has been described in considerable detail with reference to certain embodiments thereof, other embodiments are possible. Therefore, the spirit and scope of the appended claims should not be limited to the description of the embodiments contained herein.

What is claimed is:

1. A liquid crystal display device, comprising:

a time sequence control circuit configured to output a data signal and a control signal after receiving a first instruction signal;

a display panel configured to display at least one image by a plurality of frame display frequencies according to the data signal; and a backlight source configured to illuminate the display panel by a plurality of backlight flicker frequencies according to the control signal;

wherein the display panel displays the at least one image having a plurality of frame flicker frequencies according to the backlight flicker frequencies and the frame display frequencies;

wherein the display panel comprises a plurality of display regions, and the frame flicker frequencies correspond to a corresponding display region of the display regions;

wherein the display panel is driven in accordance with the data signal to change at least one continuous period of at least one bright frame displayed in the display regions, thereby adjusting the frame display frequencies, wherein the at least one continuous period of the at least one bright frame is longer than one frame, and the at least one bright frame is followed a plurality of consecutive black frames, wherein the backlight source comprises a plurality of backlight units, each of the backlight units corresponds to one of the backlight flicker frequencies, and the backlight flicker frequency of one of the backlight units is different from that of another of the backlight units, wherein when receiving the first instruction signal representing a first time of visual fatigue test, the time sequence control circuit is configured to record a first critical fusion frequency (CFF) threshold and control the frame display frequencies and the backlight source, thereby enabling the display panel to display the at least one image having the frame flicker frequencies which has been adjusted once, wherein after a period of time, the time sequence control circuit is configured to receive a second instruction signal representing a second time of visual fatigue test, and to record a second CFF threshold and control the frame display frequencies and the backlight source, thereby enabling the display panel to display the at least one image having the frame flicker frequencies which has been adjusted twice, wherein the time sequence control circuit generates a determination result in accordance with the first CFF threshold and the second CFF threshold.

2. The liquid crystal display device of claim 1, wherein the time sequence control circuit is further configured to receive an input signal and to determine if the input signal indicates that one of the display regions has a specific frequency range, wherein when the time sequence control circuit determines that the input signal does not indicate that one of the display regions has the specific frequency range, the display regions are driven to update the frame flicker frequencies, and the updated frame flicker frequencies are arranged in order from high frequency to low frequency.

3. The liquid crystal display device of claim 1, wherein the time sequence control circuit is further configured to receive an input signal and to determine if the input signal indicates that one of the display regions has a specific frequency range, wherein when the time sequence control circuit determines that the input signal does not indicate that one of the display regions has the specific frequency range, the display regions are driven to update the frame flicker frequencies, and the updated frame flicker frequencies are arranged in order from low frequency to high frequency.

4. The liquid crystal display device of claim 1, wherein the time sequence control circuit is further configured to receive an input signal and to determine if the input signal indicates that one of the display regions has a specific frequency range, wherein when the time sequence control circuit determines that the input signal does not indicate that one of the display regions has the specific frequency range, the display regions are driven to update the frame flicker frequencies, and the updated frame flicker frequencies are arranged in a random order.

5. The liquid crystal display device of claim 1, wherein the display panel is driven in accordance with the data signal to change times of the bright frames and the dark frames alternately displayed in time in the display regions, thereby adjusting the frame display frequencies.

6. The liquid crystal display device of claim 1, wherein the control signal controls a backlight on-time corresponding to the display regions in accordance with an operation period, thereby adjusting the backlight flicker frequencies to enable the display panel to display the at least one image having the frame flicker frequencies in accordance with the backlight flicker frequencies and the frame display frequencies.

7. The liquid crystal display device of claim 1, wherein the control signal controls a backlight on-time corresponding to the display regions in accordance with a backlight display period, thereby adjusting the backlight flicker frequencies to enable the display panel to display the image having the frame flicker frequencies in accordance with the backlight flicker frequencies and the frame display frequencies.

8. A display flickering method for a liquid crystal display device comprising a display panel, the display flickering method comprising:

receiving a first instruction signal and a color selection signal by a time sequence control circuit;

outputting a data signal and a control signal according to the first instruction signal and the color selection signal by the time sequence control circuit;

displaying at least one image by a plurality of frame display frequencies according to the data signal;

illuminating, by a backlight source, the display panel by a plurality of backlight flicker frequencies according to the control signal, wherein the backlight source comprises a plurality of backlight units, each of the backlight units corresponds to one of the backlight flicker frequencies, and the backlight flicker frequency of one of the backlight units is different from that of another of the backlight units;

displaying the image having at least one a plurality of frame flicker frequencies according to the backlight flicker frequencies and the frame display frequencies by the display panel;

wherein the display panel comprises a plurality of display regions, and each of the frame flicker frequencies corresponds to a corresponding display region of the display regions;

driving the display panel in accordance with the data signal to change at least one continuous period of at least one bright frame displayed in the display regions, thereby adjusting the frame display frequencies, wherein the at least one continuous period of the at least one bright frame is longer than one frame, and the at least one bright frame is followed by a plurality of consecutive black frame;

when receiving the first instruction signal representing a first time of visual fatigue test, recording a first critical fusion frequency (CFF) threshold and controlling the frame display frequencies and the backlight source, thereby enabling the display panel to display the at least one image having the frame flicker frequencies which have been adjusted once;

after a period of time, receiving a second instruction signal representing a second time of visual fatigue test, and recording a second CFF threshold and controlling the frame display frequencies and the backlight source, thereby enabling the display panel to display the at least one image having the frame flicker frequencies which has been adjusted twice; and generating a determination result in accordance with the first CFF threshold and the second CFF threshold.

9. The display flickering method of claim 8, the display flickering method further comprising:

receiving an input signal by the time sequence control circuit, and determining whether the input signal indicates that one of the display regions has a specific frequency range by the time sequence control circuit; and driving the display regions to update the frame flicker frequencies, and arranging the updated frame flicker frequencies in order from high frequency to low frequency, when the time sequence control circuit determines that the input signal does not indicate that one of the display regions has the specific frequency range.

10. The display flickering method of claim 9, further comprising:

driving the display panel in accordance with the data signal to change times of the bright frames and the dark frames alternately displayed in time in the at least one display region, thereby adjusting the frame display frequencies.

11. The display flickering method of claim 9, further comprising:

controlling a backlight on-time corresponding to the display regions in accordance with an operation period by the control signal, thereby adjusting the at backlight flicker frequencies to enable the display panel to display the at least one image having the frame flicker frequencies in accordance with the backlight flicker frequencies and the frame display frequencies.

12. The display flickering method of claim 9, further comprising:

controlling a backlight on-time corresponding to the display regions in accordance with a backlight display period by the control signal, thereby adjusting the backlight flicker frequencies to enable the display panel to display the at least one image having the frame flicker frequencies in accordance with the backlight flicker frequencies and the frame display frequencies.

13. The display flickering method of claim 8, the display flickering method further comprising:

receiving an input signal by the time sequence control circuit;

determining if the input signal indicates that one of the display regions has a specific frequency range by the time sequence control circuit; and driving the display regions to update the frame flicker frequencies, and arranging the updated frame flicker frequencies in order from low frequency to high frequency, when the time sequence control circuit determines that the input signal does not indicate that one of the display regions has the specific frequency range.

14. The display flickering method of claim 8, the display flickering method further comprising:

receiving an input signal by the time sequence control circuit;

determining if the input signal indicates that one of the display regions has a specific frequency range by the time sequence control circuit; and driving the display regions to update the frame flicker frequencies, and arranging the updated frame flicker frequencies in a random order, when the time sequence control circuit determines that the input signal does not indicate that one of the display regions has the specific frequency range.

* * * * *